US005522188A

United States Patent [19]

Cornelius

[11] Patent Number: 5,522,188

[45] Date of Patent: Jun. 4, 1996

[54] EARTH BRACE SYSTEM FOR SWIMMING POOLS—IN THE GROUND

[76] Inventor: Kerry J. Cornelius, 40 Leeson Street, St. Catharines, Ontario, Canada, L2T 2R4

[21] Appl. No.: 307,011

[22] Filed: Sep. 16, 1994

[51] Int. Cl.[6] ..... E02D 27/00

[52] U.S. Cl. ..... 52/169.8; 52/169.7; D25/2

[58] Field of Search ..... 52/169.7, 169.8; D25/2

[56] References Cited

U.S. PATENT DOCUMENTS

| | | | |
|---|---|---|---|
| 3,444,659 | 5/1969 | Shanni | 52/169.8 |
| 4,077,173 | 3/1978 | Rozanski | 52/169.8 |
| 4,548,005 | 10/1985 | Glonek et al. | 52/169.8 |

*Primary Examiner*—Wynn E. Wood

*Assistant Examiner*—W. Glenn Edwards

*Attorney, Agent, or Firm*—Wallace F. Neyerlin

[57] ABSTRACT

A bracing system for in-ground steel and vinyl swimming pools that allows the pool to be constructed very quickly and without the use of concrete either on the braces or around the bottom perimeter of the pool is described. The bracing system works by properly using the resistance of undisturbed earth around the perimeter of the pool (after excavating for the pool) and the weight and correct placement of the back-fill material reintroduced around the pool. Each earth brace system is comprised of a number of structural components in contact with peripheral wall panels of the pool. These include a horizontal lower structural member, an upper structural member, a diagonal brace member and a vertical support member. The horizontal and upper structural members each possess load bearing pad assemblies at their ends away from the wall panels to contact undisturbed earth surrounding the pool (after excavation).

8 Claims, 17 Drawing Sheets

144
45
51
43a
200
14
6'
42
14
44
41a
6
64
49
6'''''
50
6''

Fig. 7
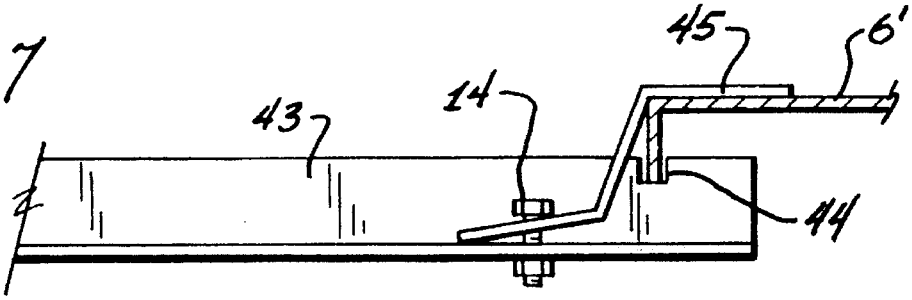
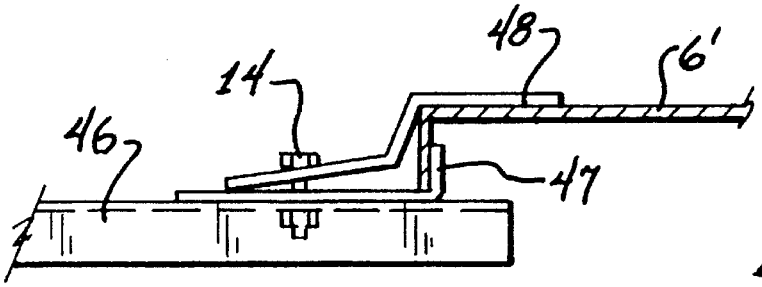
Fig. 7a
Fig. 7b
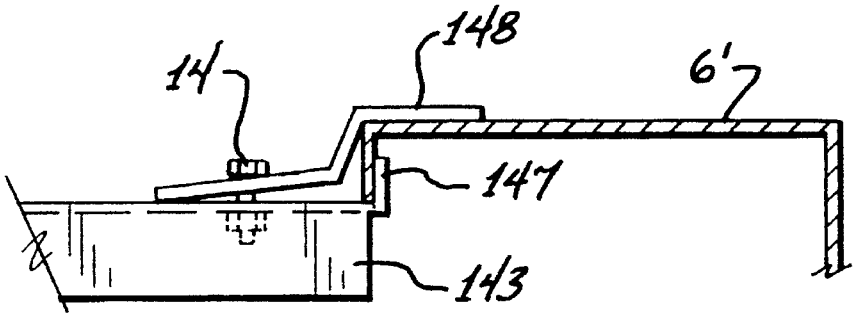
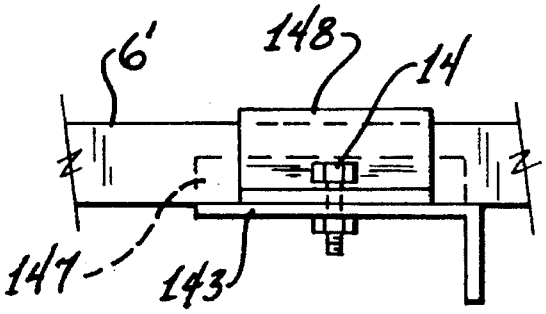
Fig. 7c

Fig. 10
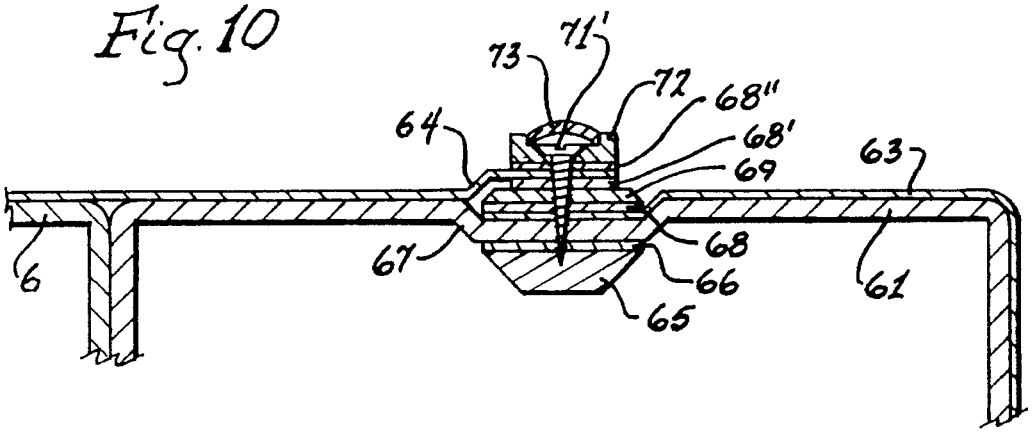
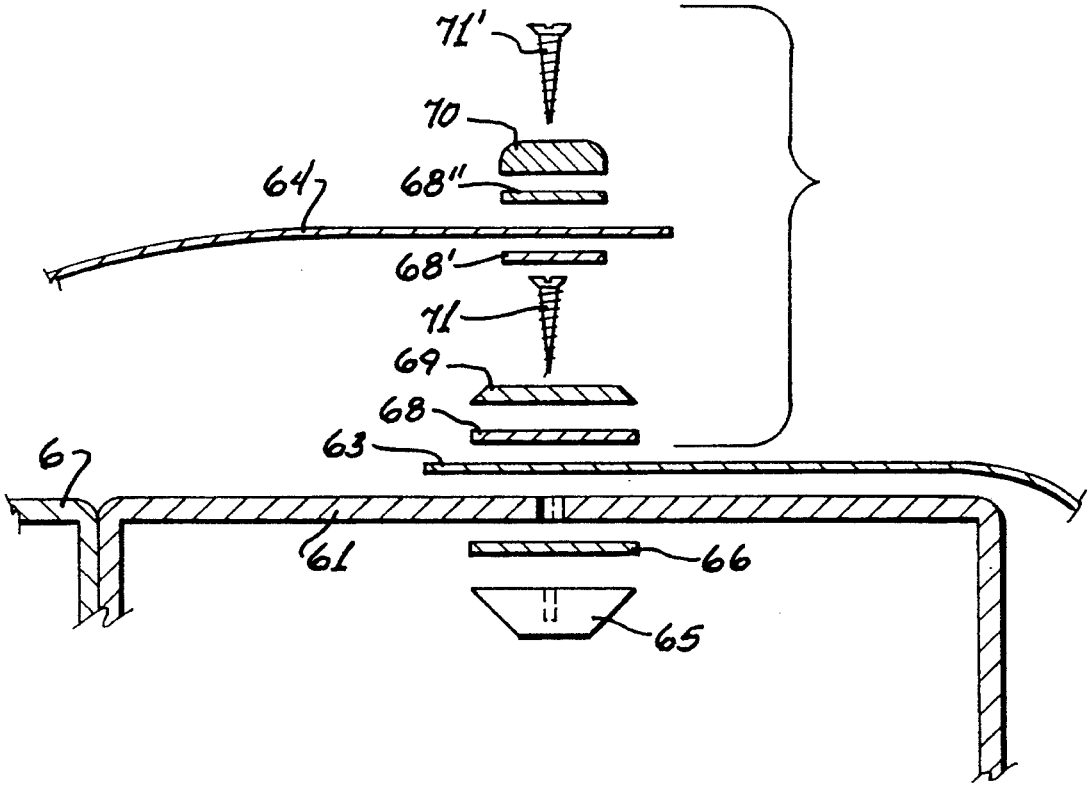
Fig. 11

EARTH BRACE SYSTEM FOR SWIMMING POOLS—IN THE GROUND

BACKGROUND OF THE INVENTION

1. Field of the Invention

The invention relates to in-ground steel and vinyl swimming pools and more specifically to a bracing system for such pools that allows the pool to be constructed very quickly (usually in one day) without the use of concrete either on the braces or around the bottom perimeter of the pool.

The invention also relates to a vinyl swimming pool stair liner and face plate system that may be universally mounted anywhere along the perimeter of any in-ground swimming pool.

The invention also relates to a ladder bracket anchor support assembly for a vinyl swimming pool that may be universally mounted anywhere along the perimeter of any in-ground swimming pool.

2. Description of the Prior Art

A search was carried out in the United States Patent Office for prior art that might teach or suggest features of the present invention as referred to above. It is not believed that the prior art found in the search would negate the novelty and patentability of the structures of this invention as herein described and illustrated in detail.

The search was conducted in Class 52, sub-class 169.7; Class 244, sub-class 4; Class 249, sub-classes 3, 4, and 7; and Class 405, sub-classes 229, 276, 282, 283, 294, 295, and 297.

The following patents were selected as having some related structural features but are not believed to teach or suggest the inventive concepts of the present invention.

| Patent Number | Issue Date | Title |
|---|---|---|
| 3,820,174 | 06/28/1974 | Swimming Pool Construction |
| 4,020,509 | 05/03/1977 | Combination Wood and Aluminum Swimming Pool Structure |
| 4,548,005 | 10/22/1985 | Structural Foam Swimming Pool Wall and Brace and Method of Erecting Same |
| 5,018,324 | 05/28/1991 | Swimming Pool Wall |

SUMMARY OF THE INVENTION

The bracing system works by properly using the resistance of undisturbed earth around the perimeter of the pool (after excavating for the pool) and the weight and correct placement of the back-fill material reintroduced around the pool. By following the teachings of this invention, an in-ground steel and vinyl swimming pool can be installed within one day, using no concrete and be strong enough to withstand either of the two unusual conditions in-ground swimming pools are exposed to occasionally throughout their usage, which are: a) filled with water with no back-fill; or b) back-filled with no water (which could occur during liner replacement).

The universally mounted vinyl swimming pool stair liner and face plate system describes a method of and means for locating the vinyl covering over the stairs into a steel and vinyl swimming pool in any location in which the steel stairs are located without having the location of the stairs predetermined and the vinyl stairs prefabricated into the liner in advance at the liner factory. This is accomplished by means of fabricating a vinyl stair covering, separate from the basic pool liner and securing it at any location at which the steel portion of the stairs are located and waterproofing it by means of a double layer face plate system around the exposed surface of the stairs. The system works because the double layer face plate is actually joining the stair liner to the pool right at the construction site and also locating and waterproofing the stairs and liner to the pool wall.

The universal mount ladder anchor support bracket system describes an attaching method for a ladder anchoring system on a swimming pool which allows the ladder bracket anchoring system to be located anywhere around the perimeter of the pool without pre-punched holes, slots, tabs, etc.

The system works because of two features: feature A is a clamping means comprised of two vertical pieces of rigid material, the tops of which are attached to the top of the pool wall, a horizontal member which clamps to the tops of the vertical members and also attached to the top flange of the pool wall in any location around the perimeter of the pool; and feature B of which is the way or means by which the bottoms of the vertical members "clip" onto a bottom flange of the swimming pool wall by means of the shaped "cut outs" at the base of the vertical members which securely couple to the flange on the bottom walls of the swimming pool.

The preferred embodiment of the invention includes the combination of building an in-ground swimming pool employing all three systems as above referred to, i.e., the bracing system, the step liner and the face plate system, and the ladder anchor support bracket system, all of which are hereinafter described in detail, but each of which separate systems are also considered novel with the present invention.

BRIEF DESCRIPTION OF THE DRAWINGS

FIG. 5*a*' is an enlarged view of the lower portion of the ladder bracket anchor support assembly of FIG. 5, included to illustrate notch or cut-out 49 in the bottom portion of diagonal support member 41*a*.

FIG. 7 is an enlarged side view of a portion of the top part of the ladder bracket anchor support assembly of FIG. 5, taken across cut line 7—7 of FIG. 6.

FIG. 7*a* is an enlarged side view of a portion of an alternative construction of the top part of a ladder bracket anchor support assembly of this invention.

FIG. 7*b* is an enlarged detail side view (partial) of FIG. 4*a*.

FIG. 7*c* is an enlarged detail end view (partial) of FIG. 4*a*.

FIG. 10 is an enlarged cross section of one embodiment of a pool stair liner and face plate system that enables the stairs and liner to be installed at any desired location within the pool.

FIG. 11 illustrates an alternative liner and face plate system for enabling the stairs and liner to be installed at any desired location.

DETAILED DESCRIPTION OF THE DRAWINGS AND OF THE PREFERRED EMBODIMENTS OF THE INVENTION

Figure 1:
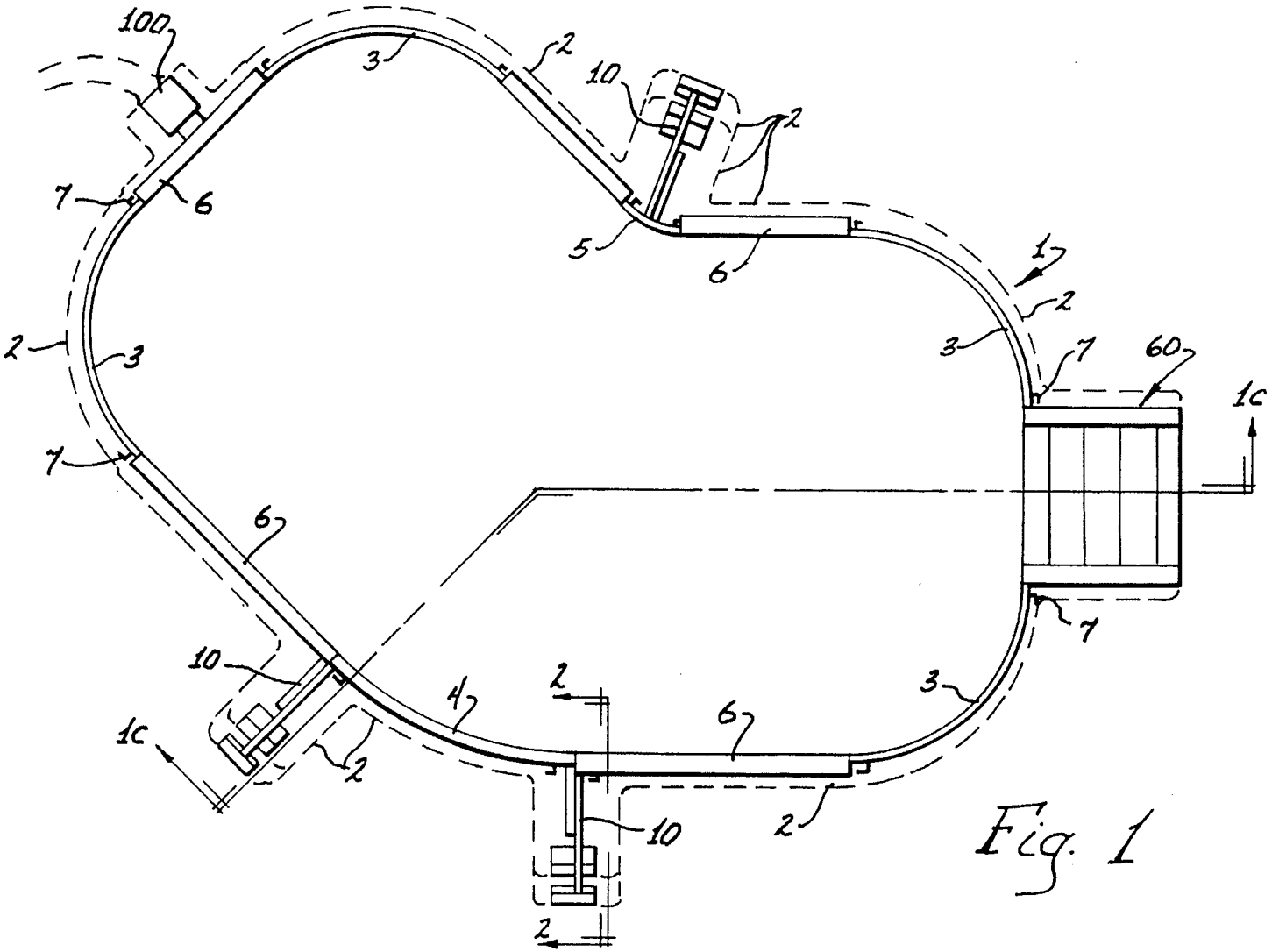
FIG. 1 is a top plan view of an in-ground pool framework sitting in its excavation. The shape shown is referred to as having a braced "little L" shape. Other pool shape designs are many, preferably including triangular, as shown in FIG. 1*a* and kidney shaped pools, as shown in FIG. 1*b*, with rounded corners or edges similar to those illustrated in FIGS. 1 and 1*a*.
Figure 1A:
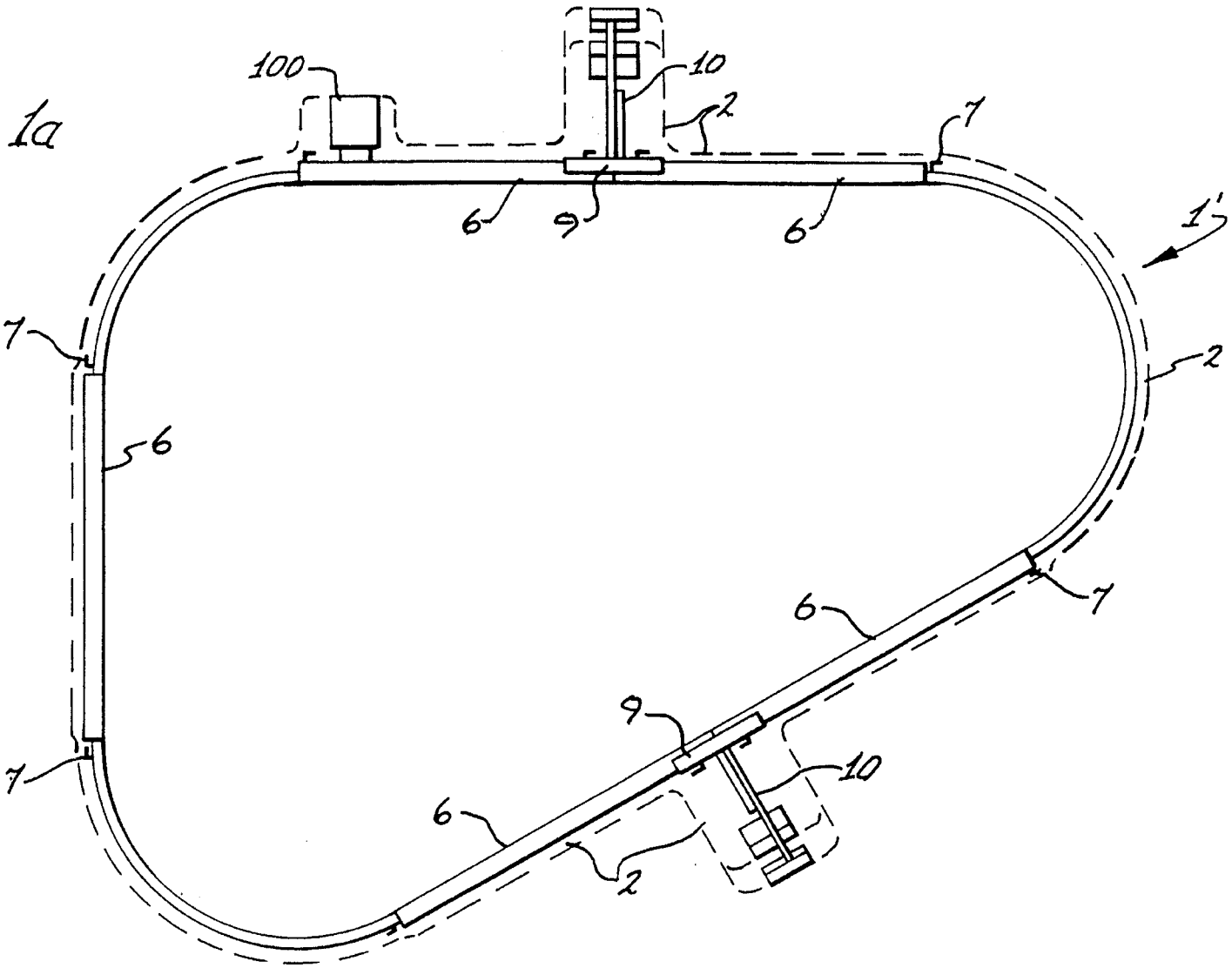
FIG. 1*c* is a cross-section (broken) view of the pool of FIG. 1 taken across cut-line 1*c*—1*c* of FIG. 1 and illustrates that the teachings of the present invention apply to pools with deep ends, as well as pools which are entirely shallow.
Figure 1B:
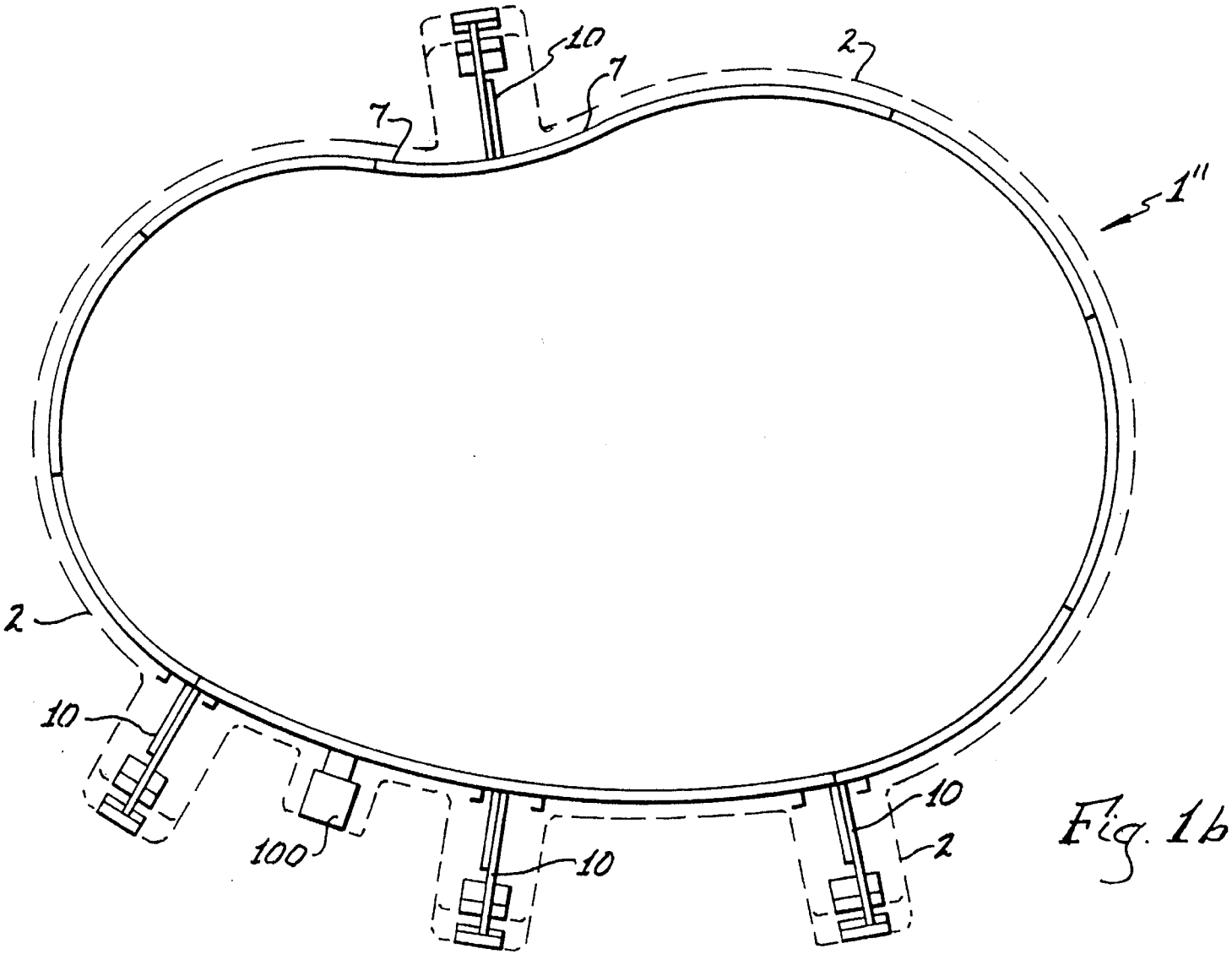
Figure 1C:
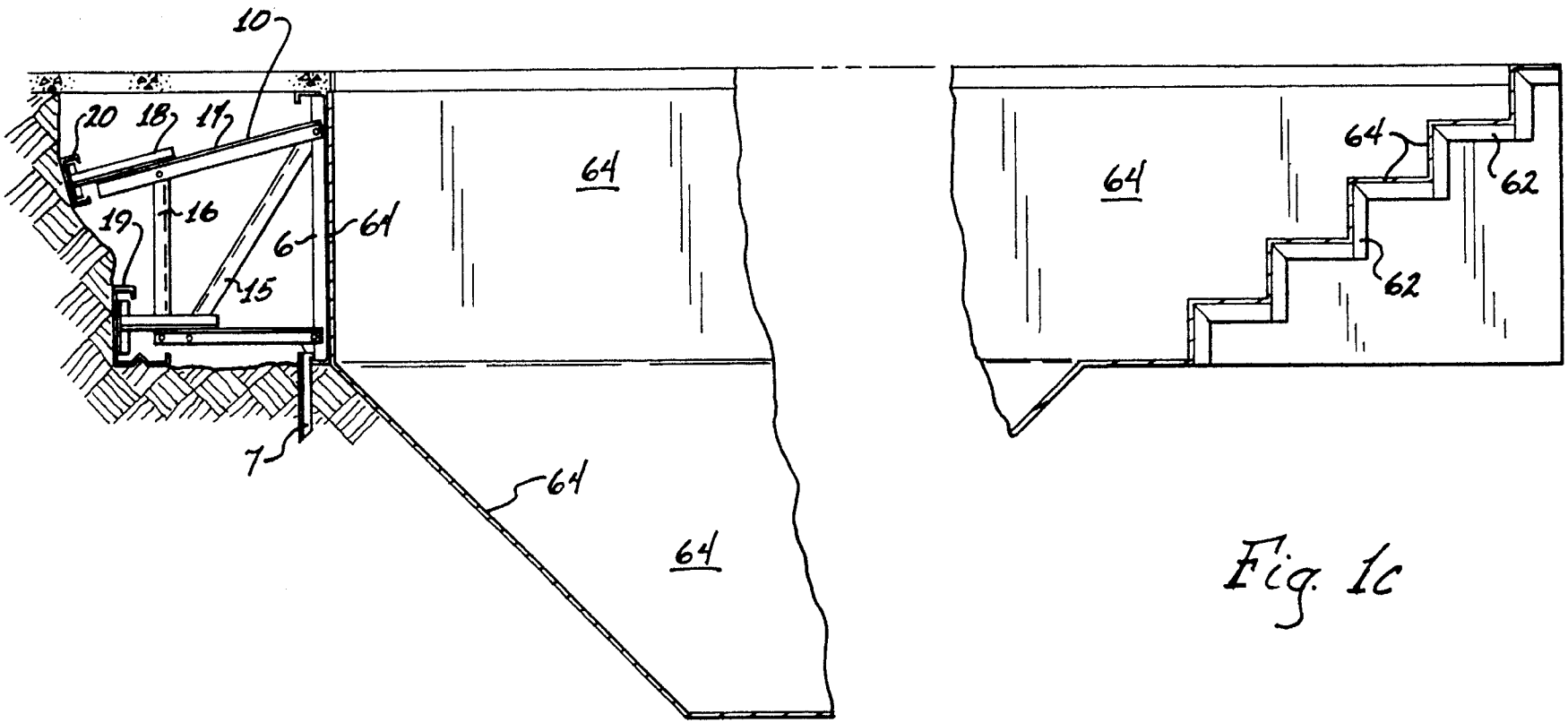
Figure 2:
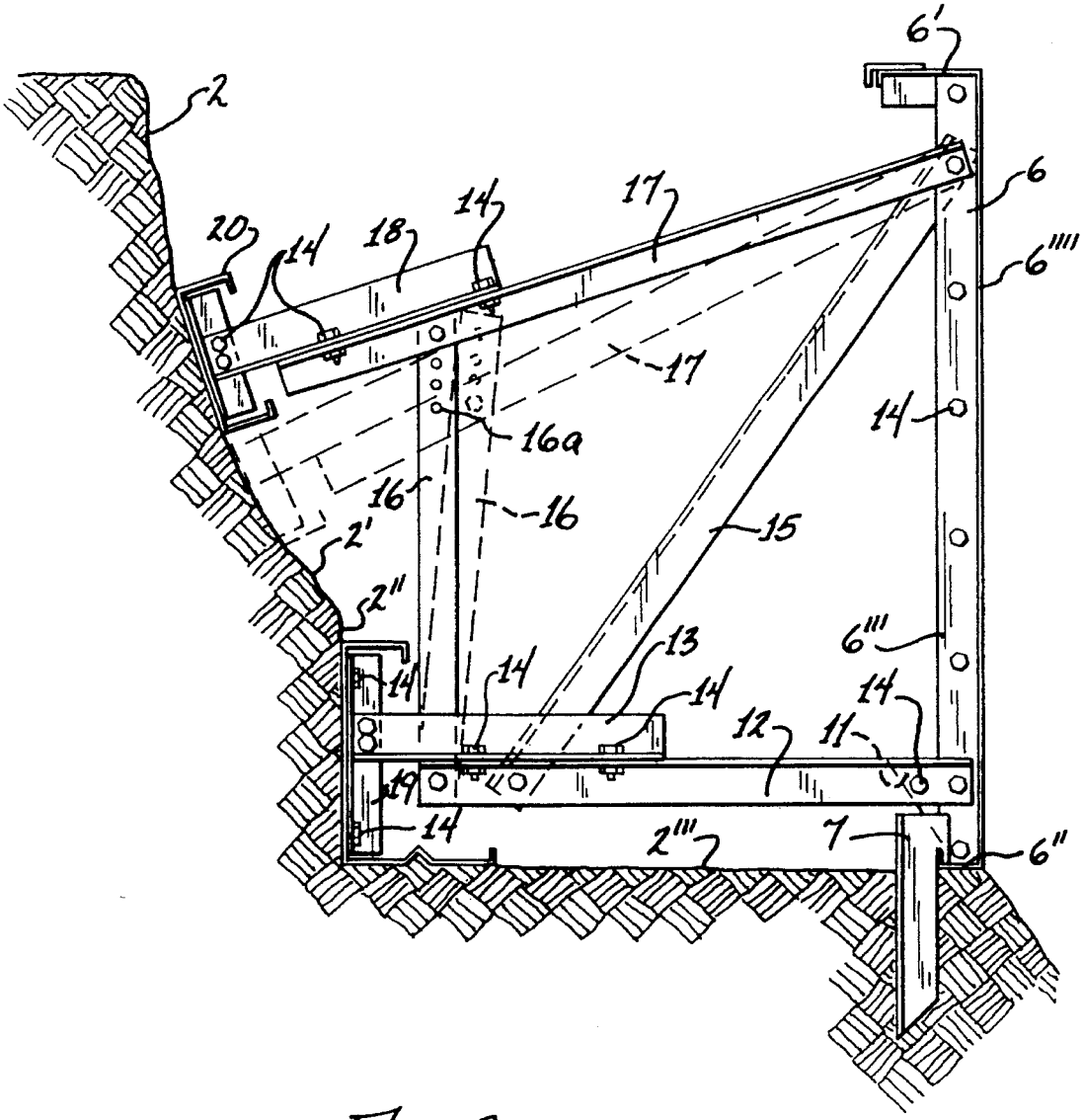
FIG. 2 a vertical sectional side view of the earth brace system of the present invention taken across cut line 2—2 of FIG. 1.

In FIG. 1, numeral 1 refers to the pool framework in general. Dotted line 2 depicts the outer limits of the excavation of the pool. As shown in FIG. 2, this outer limit can sometimes be a sloped portion 2' of the excavation, or a vertical portion 2" of the excavation, or a substantially flat horizontal portion 2'" of the excavation. In pools having deep ends, such as illustrated in FIG. 1*c*, the limit of excavation will, of course, be deeper than depth 2'" and such limit of excavation may also not be horizontal. The structural perimeter of the pool can consist of substantially straight panels 6, rounded ninety degree inside bend panels 3, and rounded forty-five degree inside bend panels 4, etc. Similar straight or curved panels are also employed in pool designs such as illustrated in FIGS. 1*a* and 1*b*. Numeral 5 depicts structural support bend panels for the pool. The pool panels are kept in vertical alignment by the various earth brace systems referred to in general by numeral 10. An ample number of such bracing systems are provided around the perimeter of the pool to assure proper rigidity of structure of the pool for a number of years. Numeral 60 of FIG. 1 refers to the stair assembly which, as aforesaid, may be located substantially anywhere as desired except for the locations of the bracing systems 10 and the location of the pump station 100.

In FIG. 1*a*, numeral 1' refers to the triangular shaped pool and in FIG. 1*b* numeral 1" refers to the kidney shaped pool. Numeral 7 in each of these figures designates stakes or rods which are used in the building of all of the pools and whose placement, configuration and function are described hereinafter.

Figures 2A, 2B, 2C:
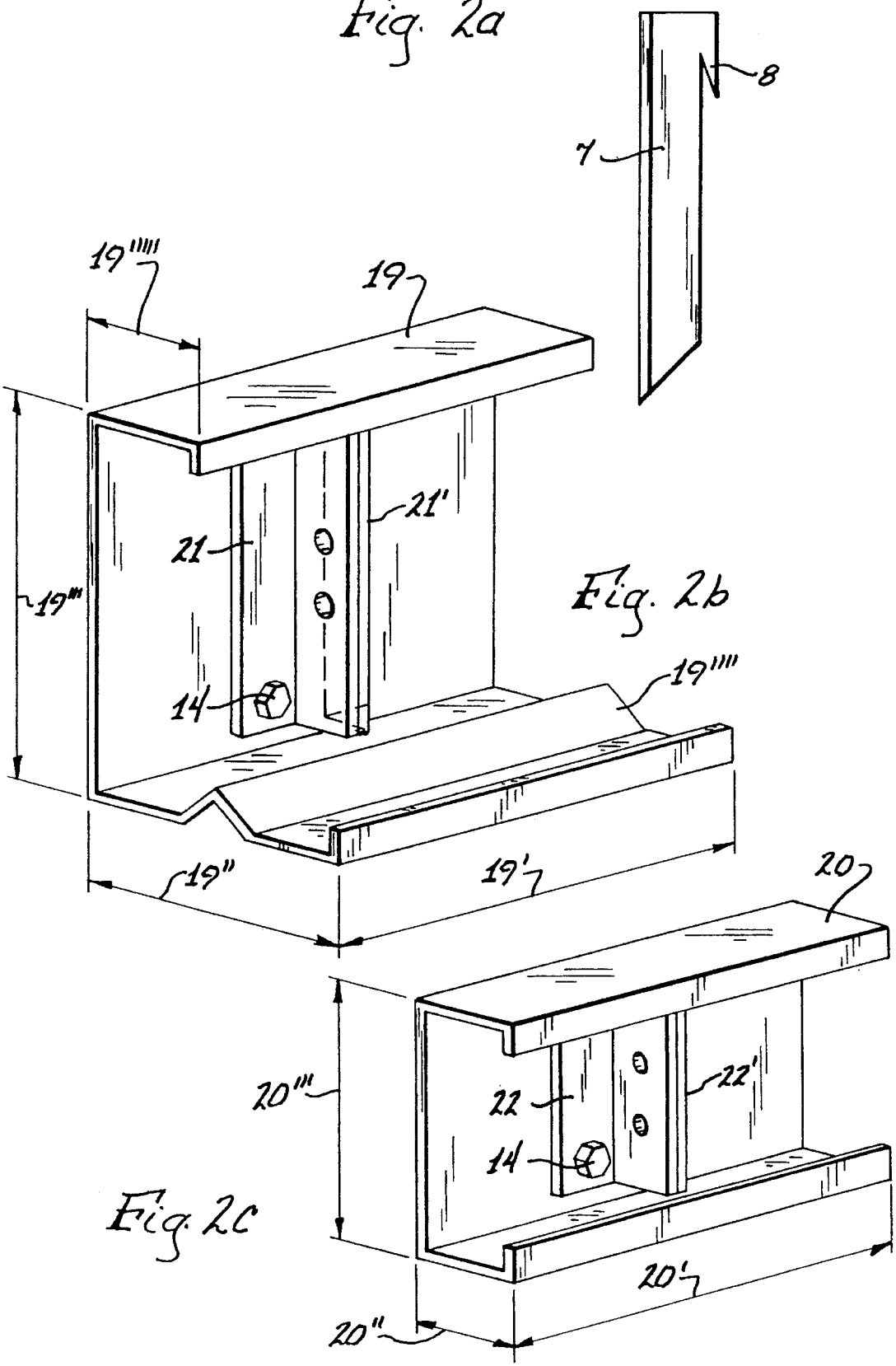
FIG. 2*a* is a perspective view of a stake as used at the bottom of the bracing system.
FIG. 2*b* is an isometric perspective view of the lower load bearing pad assembly 19 of FIG. 2.
FIG. 2*c* is an isometric perspective view of the upper load bearing pad assembly 20 of FIG. 2.

In FIG. 2, numeral 6 refers to a straight peripheral panel, 6' depicts a top flange of panel 6, 6" a bottom flange of panel 6, 6'" a side flange of panel 6, and 6"" an external vertical face of panel 6, which will later be covered with the pool liner. Numeral 7 depicts a stake or rod typically about 14 to 16 inches long which is driven into the ground about 90% of its length to provide support and stability for the panels of the pool about its periphery. Stake or rod 7 preferably has a hook 8 (as shown in FIGS. 2 and 2*a*) at its upper end so as to overlap a bottom flange 6" of panel 6 to provide the support and stability of structure that is desired. The triangular shaped pool of FIG. 1*a* will typically be about 23 feet in length in its longest leg, about 15½ feet long in its shortest leg and about 21 feet long in its other leg and will typically use or require about ten "hook stakes" in its reinforcement, including two at each earth brace.

Each earth brace system 10 is comprised of a number of structural components (typically made of formed steel) besides the peripheral panels 6, 3 or 4, etc. These include a substantially horizontal lower formed steel structural member 12, an upper structural member 17,,a diagonal brace structural member 15 and a substantially vertical support member 16. Horizontal structural member 12 and upper structural member 17 each possess means on or within their ends which are distant from wall panel 6 for enabling a controllable distance of load bearing pad assembly 19 and load bearing pad assembly 20 away from the wall panel. As shown in FIG. 2, structural member 13, attached to the top of horizontal member 12, provides an efficient means for controlling the distance away from wall panel 6 of the lower load bearing pad assembly 19 and structural member 18, atop member 17, also provides efficient means for controlling the distance away from wall panel 6 of the upper load bearing pad assembly 20. Other means for controlling the distance away from wall panel 6 of the upper and lower load bearing pad assemblies 20 and 19 include "threadably", engaging member 18 to member 17 and/or threadably engaging member 13 to member 12 rather than coupling such members to each other by means of nuts and bolts as illustrated in FIG. 2. (Structural features of these load bearing pad assemblies are described in more detail hereinafter in describing FIGS. 2*b* and 2*c*).

Numeral 11 in FIG. 2 denotes a triangular shaped gusset member for providing support and coupling between wall panels 6 and lower horizontal member 12. Numeral 16*a* denotes numerous adjustment holes which may be used in vertical support member 16 (and also elsewhere in other of the structural members) to provide convenient alignments and coupling of the various support members; and numeral 14 denotes nuts and bolts utilized to connect the various members together where desired.

Upper structural member 17 in FIG. 2 is shown at an angle of about fifteen degrees from horizontal in solid lines and at an angle of about twenty-five degrees from horizontal by dotted lines. These placements are very near the minimum and maximum as found by experimentation, to provide the structural support required and as desired to carry out the purposes of the invention. The lower location of this member at twenty-five degrees may be necessary in order to reach down into, and for the load bearing pad assembly 20 to abut against, original solid ground or unexcavated earth.

Figure 3:
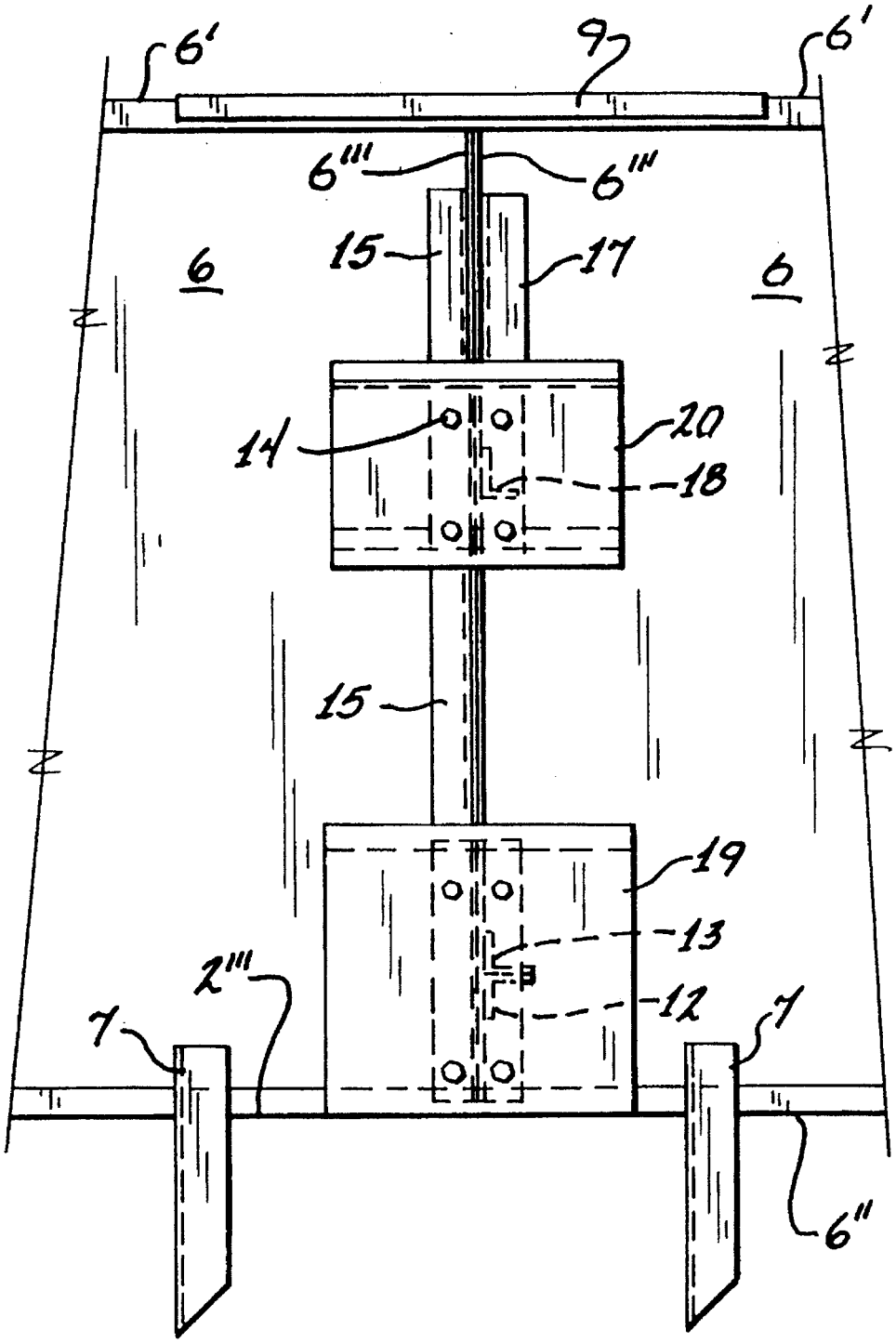
FIG. 3 is a vertical rear elevational view of the earth brace system of FIG. 2 as installed on the pool site. It is to be noted that the pool of FIG. 1 employs three such earth brace support systems whereas other pool configurations (such as previously referred to) may only require two, or may require four or more for proper support depending upon size and also upon the particular shape.

Several of the foregoing elements of the support structure are also shown or repeated in FIG. 3, the rear elevational view of one of the earth brace systems of the present invention connected to wall panel 6.

Fourteen gauge galvanized steel is a preferred material of construction employed in the walls and structural enforcement members of the invention as above described, but it should be noted that other materials of construction can also be used, such as plywood, rigid foam or cast aluminum, providing these materials are of sufficient thickness and strength.

Typical dimensions of the structural elements of the present invention are as follows:

Wall panels 6—42 inches in height

Horizontal support member 12—28¾ inches long

Diagonal support member 15—42 inches long

Vertical support member 16—27 inches long

Upper angular support member 17—37¼ inches long

Horizontal support member 13—17 inches long

Upper angular support member 18—17 inches long

The structural wall panels of the swimming pool will preferably be made from 14 gauge galvanized steel and the various support members referred to above will preferably be angle irons of 14 gauge thickness. It should also be noted that the dimensions set forth above are those that are preferred and are based on the wall heights of most residential type in-ground swimming pools, but that the dimensions indicated can be varied by about plus or minus ten percent so long as they are so coordinated as to contribute to and result in constructing and maintaining the faces of the wall panels in substantially vertical position. (The shapes and the dimensions of upper load bearing pad assembly 20 and lower load bearing pad assembly 19 will be made clear by later reference to detailed further description of FIGS. 2 and 3).

The minimum width at the bottom of the excavation as illustrated in FIG. 2 should be about 2 feet, 9 inches; and the minimum width at the top of the excavation should be about 3 feet, 5 inches. The bearing surfaces for the load bearing plates or pad assemblies 19 and 20 should be original undisturbed earth, or alternately, fill that has been in place for a minimum of seven years. Being able to control the distances of the load bearing pad assemblies away from pool wall 6 generally enables the constructor of the pool to abut these assemblies against the desired strong earth support.

The top edges of the wall panels 6 are preferably reinforced across the vertical joint between the wall panels where the earth bracing systems 10 are used with 3"×1"×24" long stiffening flanges 9 (c.f. FIGS. 1*a*, 2 and 3) and preferably also with 4"×5½"0 gussets 11 connecting them to horizontal structural members 12. Various structural variations possible are apparent from a consideration of the locations of the nuts and bolts 14, the dotted alternative settings for members 17 and 16 and the use of numerous adjustment holes 16*a* as illustrated in FIG. 2.

The load bearing pad assemblies 19 and 20 are important in the carrying out of the desired bracing of the walls of the pool and must be of sufficient size and strength to be expected to keep the walls vertically straight for a number of years.

The height 19''' of lower pad assembly 19 is typically about 12 inches, its width at its base 19'' is typically about 8 inches, its width at its top 19'''' is about 3½" and its length 19' is about 12½ inches. Its base is preferably "triangulated" near its middle 19'''' for strength purposes. Its back surface is reinforced by angle 21 bolted to same near its center by bolts 14 and angle 21' with two holes in same as shown serves the purpose or means of connecting structural member 13 to pad assembly 19.

Upper load bearing pad assembly being channel shaped is constructed somewhat differently than pad assembly 19. Its height 20''' is typically about 8 inches, its width 20'' is about 3 inches and is the same at top and bottom and its length 20'' is typically about 12 inches. Its back surface is reinforced by member 22; and angle 22' with two holes in same as shown serves the purpose of means of connecting structural member 18 to pad assembly 20.

FIGS. 4, 4*a*, 5, 5*a*, 5*a*', 5*b*, 6, 6*a*, 7, 7*a*, 7*b* and 7*c* all illustrate various design features of the universal mount ladder bracket anchor support assembly which allows the ladder bracket anchor support assembly to be located anywhere around the perimeter of the pool without having to employ or resort to using pre-punched holes, or slots or tabs, etc., either in the wall of the pool or in the level ground or deck area surrounding the pool.

In these figures, numeral 40 denotes the ladder bracket anchor support assembly in general; numeral 41 denotes a diagonal ladder support on the left and 41*a* denotes a right hand diagonal support. Numeral 6 denotes a straight panel to which the ladder assembly is attached; 6' being its top flange; 6'' its bottom flange, 6''' its side flange; 6'''' (FIG. 2) the side of the panel which faces the pool water and 6''''' denotes vertical flanges at the bottom of panels 6 which flanges fit and lock into notches 49 in the bases of right and left hand diagonal ladder supports 41*a* and 41 in FIGS. 5, 5*a*, 5*a*', and 6.

Figure 4:
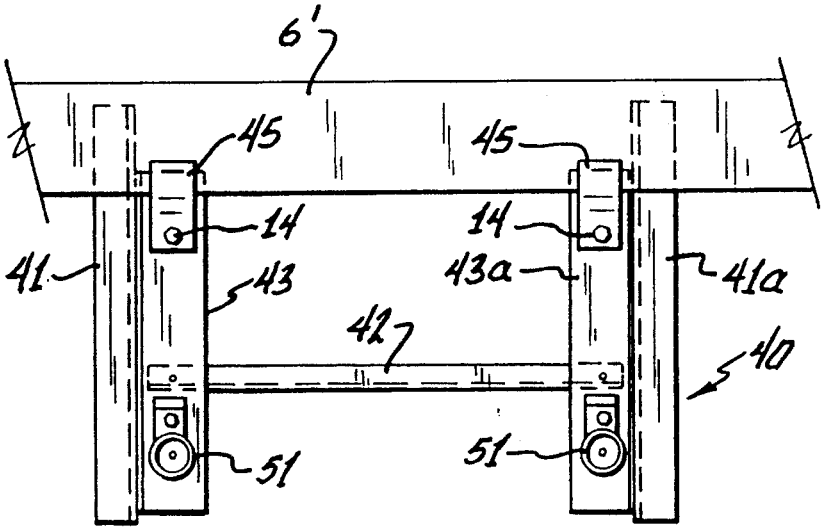
FIG. 4 is a top view of an enlarged part of the pool frame area of FIG. 1 with the ladder bracket anchor support assembly attached.
Figure 4A:
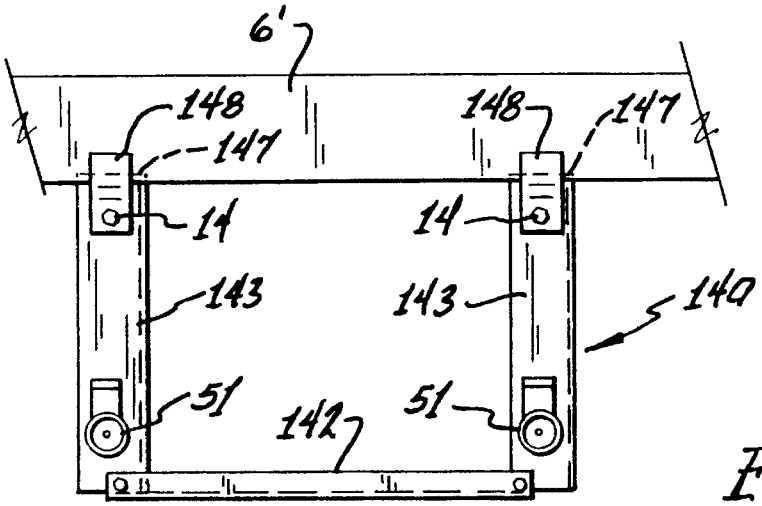
FIG. 4*a* a top view of an alternative (preferred) ladder bracket anchor support assembly of the present invention.
Figure 5:
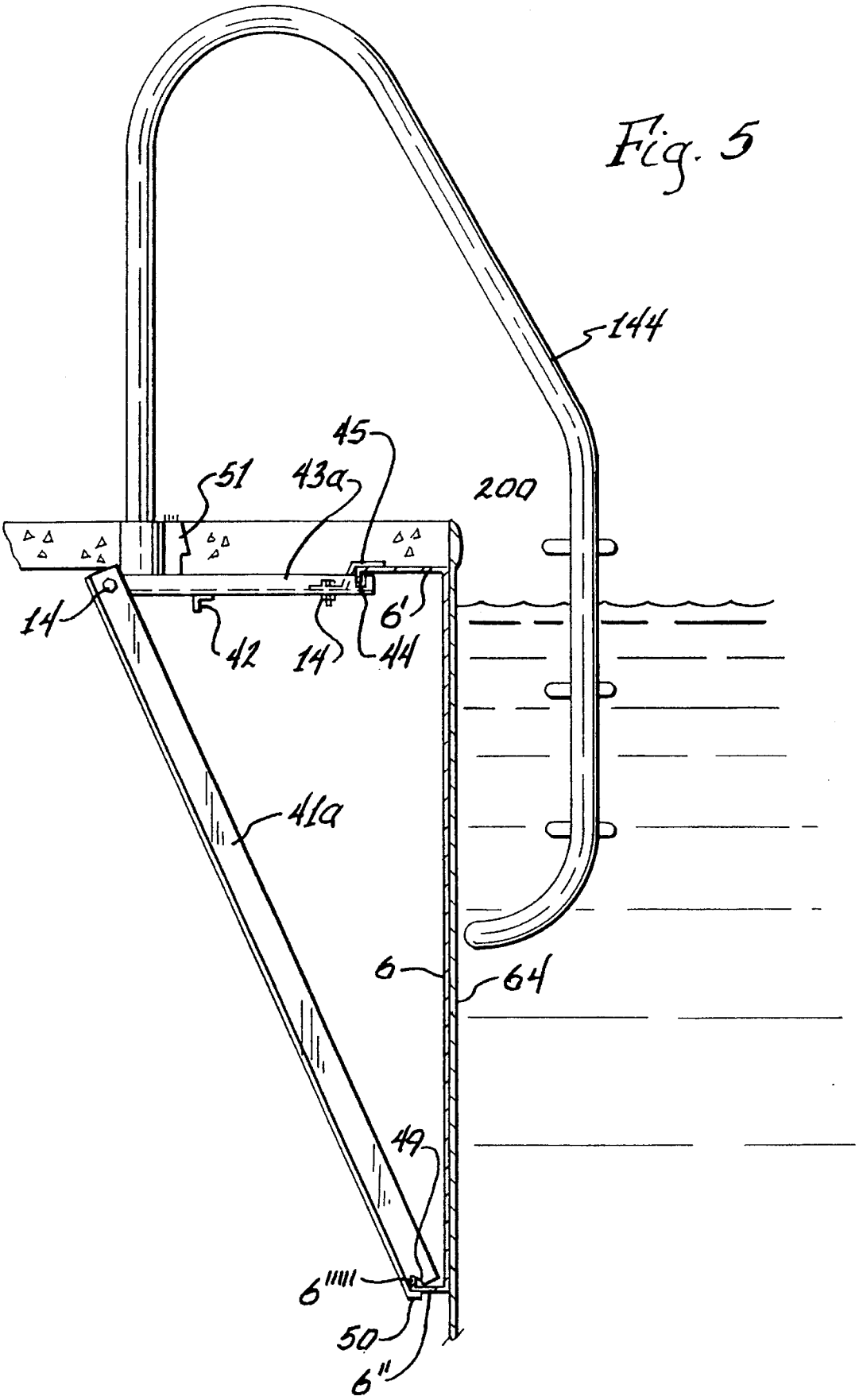
FIG. 5 is a side view of the ladder bracket anchor support assembly of FIG. 4 illustrating also the ladder attachment of said assembly, which ladder attachment extends into the water of the pool.
Figure 6:
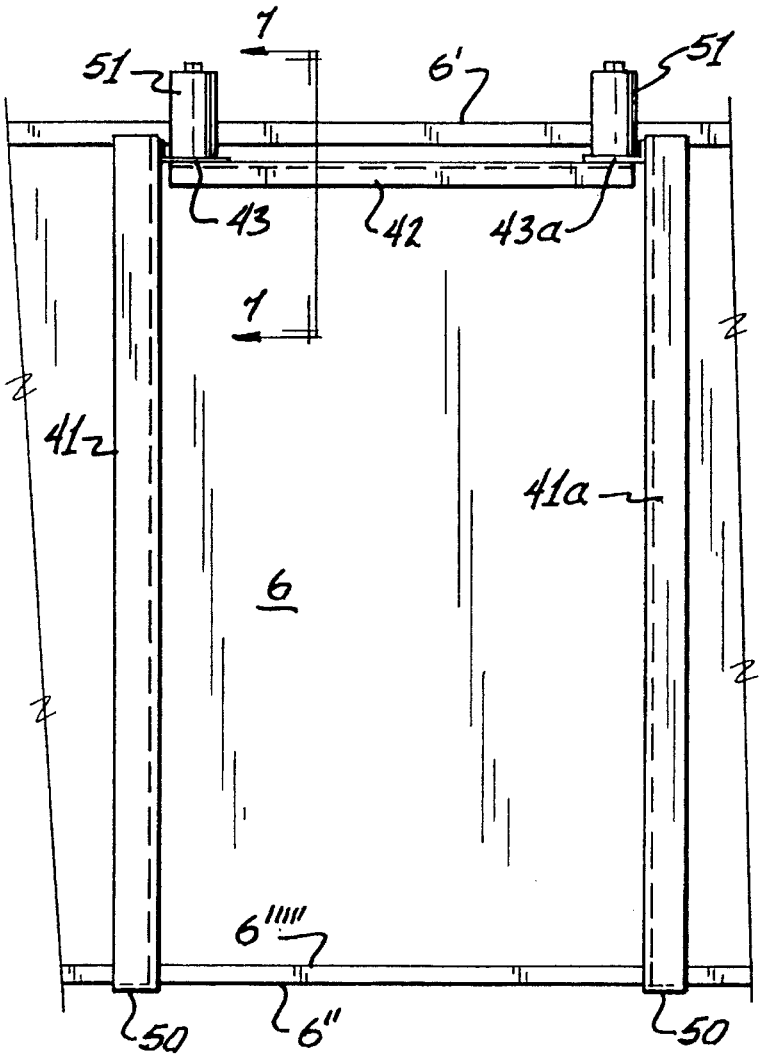
FIG. 6 is an end view of the ladder bracket anchor support assembly of FIG. 4.
Figure 6A:
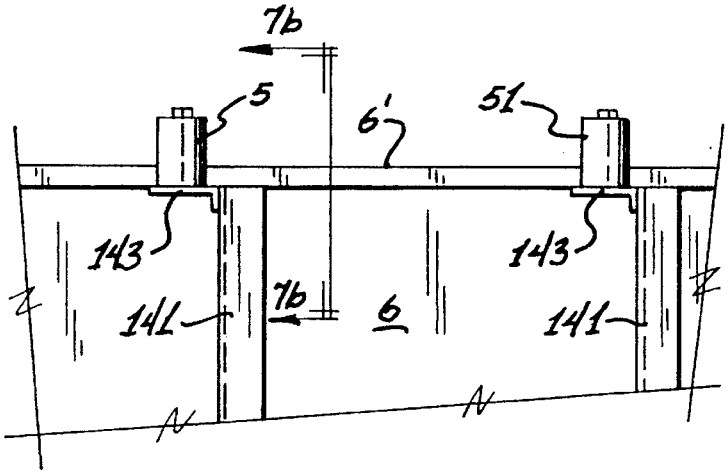
FIG. 6*a* is an end view (partial) of the alternative bracket assembly of FIG. 4*a*.

Numeral 42 denotes a reinforcing spacing bar connected between horizontal structural support members 43 and 43*a*, as shown in FIGS. 4, 5, and 6. Structural support members 43 and 43*a* are connected to the top flange 6' of wall panel 6 by means of locking straps 45 in notches 44 in each of the structural support members. These connections are shown in detail in FIGS. 5 and 7; wherein also shown is bolt and nut 14 which connect locking strap 45 to right horizontal structural support member 43*a*. Numeral 51 designates clamps for the tubular ladder members 144 which curve over atop the ladder bracket anchor support assembly and then down into the pool area 200 (FIG. 5).

FIG. 7*a* illustrates an alternative arrangement for connecting the right horizontal structural support member 43*a* to the top flange 6' of the vertical wall panel 6 of the pool. In this figure, a locking strap 48 is employed and replaces the locking strap 45 of FIG. 7 and an engagement structural support member 47 is coupled into a horizontal channel 46 in the horizontal structural support member 43*a*. A vertical portion of top flange 6' of the wall panel 6 is abutted against a vertical portion of the engagement structural support member 47 and locking strap 48 makes a tight and strong connection between 43*a* and 47 and 6' by means of nut and bolt 14 which tightly connect these various members of the ladder bracket anchor support assembly as illustrated.

Figure 5A:
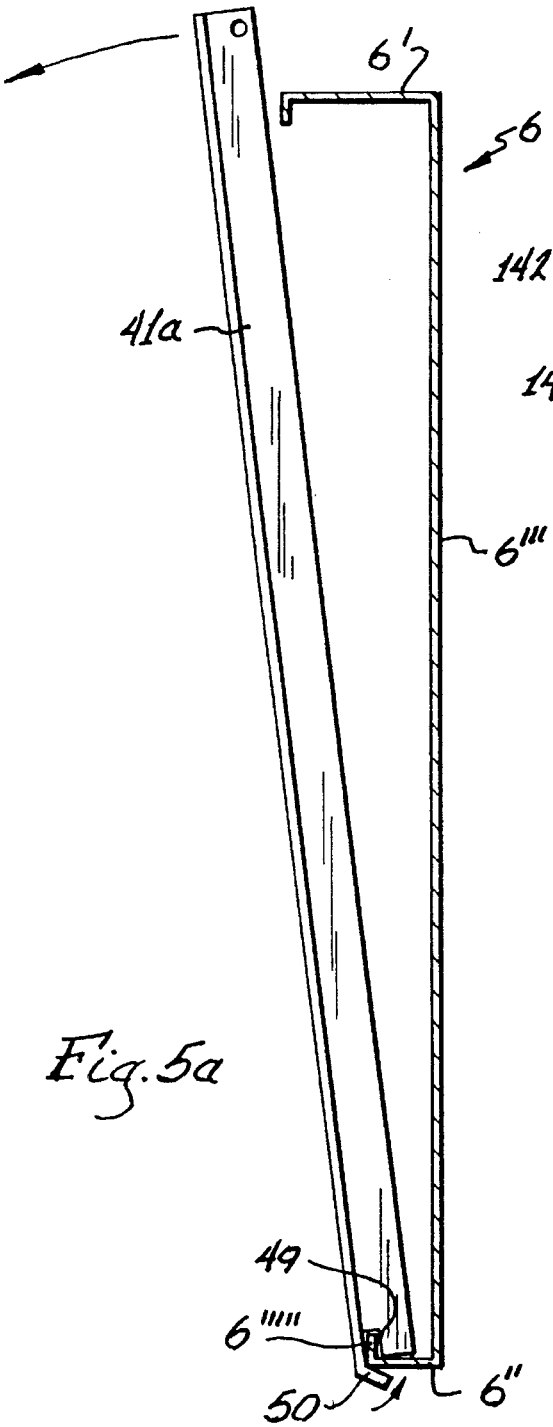
FIG. 5*a* is a view of a portion of the ladder bracket anchor support assembly of FIG. 5, included to illustrate the diagonal (but substantially vertical) support member 41*a* being installed at the bottom of the assembly.
Figure 5B:
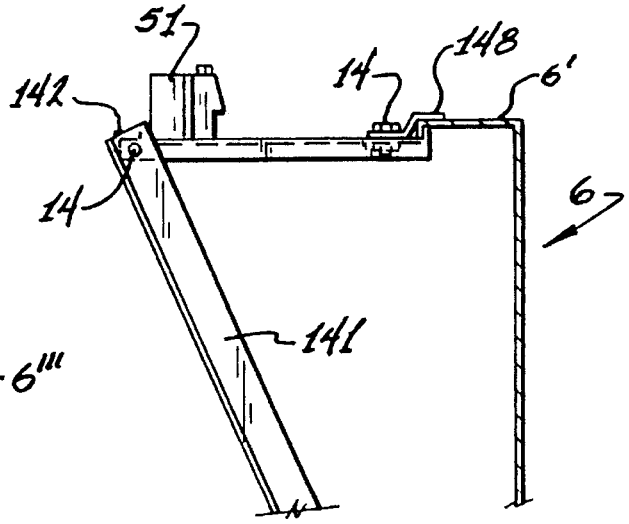
FIG. 5*b* is a side view of the top portion of the alternative bracket assembly arrangement of FIG. 4*a*.
Figure 5A:
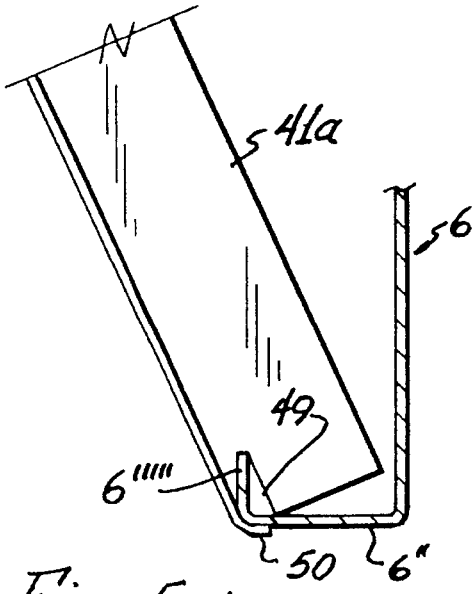

The bottom area of the ladder bracket assembly 40 is now described by reference to portions of FIGS. 5, 5*a* and 6. In these figures numeral 6" denotes a bottom flange of vertical panel 6. Flange 6" is continuous across the width of panel 6 as shown in FIG. 6. The bottom portions of diagonal supports 41 and 41*a* have notches 49 in same and the bottoms of supports 41 and 41*a* also have tabs 50 at their bottom ends. Tab 50 slides under flange 6" and notch 49 slides over and locks onto flange 6"" as the installer manipulates 41*a* away from the wall 6 as shown in FIGS. 5*a* and 5*a'*. By means of this arrangement, diagonal supports 41 and 41*a* (such as angle irons) are easily swung into place and connected to the bottom flange 6" of the vertical wall of the pool. The top ends of members 41 and 41*a*, are then bolted at the tops of the ladder bracket assemblies (c.f. FIG. 5) after which they are incapable of becoming separated either at the top or at the bottom of the assembly except by means of outside agency. It is thus to be noted that by such means, the ladder bracket assembly can be connected to the periphery of the pool at almost any desired location about its periphery.

FIGS. 4*a*, 5*b*, 6*a*, 7*b*, and 7*c* all relate to alternative structures for the ladder bracket anchor support assembly. In these figures, numeral 140 refers to the ladder bracket anchor support assembly in general; numeral 141 refers to the diagonal support members; numeral 142 refers to a spacer between diagonal supports members 141; numeral 143 refers to horizontal angle members; numeral 51 refers to a ladder clamp; numeral 147 refers to engagement tabs of the horizontal angular members 143; numeral 148 refers to locking straps and numeral 14 refers to the nuts and bolts connecting the members.

The top connections of the ladder bracket anchor support assemblies illustrated in these figures are preferred embodiments, as compared to the top connections of the ladder bracket anchor support assemblies of previously described FIGS. 4, 5*a*, 6, 7, and 7*a*.

FIGS. 5, 5*a*, 5*a'*, and 5*b* best illustrate the parts and technique employed in constructing the ladder bracket anchor support assembly of this invention, which enable the designer, installer or owner to install such assemblies at any desired location around the perimeter of the pool.

FIGS. 5*a* and 5*a'* illustrate that the top of diagonal members 41*a* may be swung away from the wall panel 6 a desired distance. The distance desired is that which enables the one doing this to lock tab 50 at the bottom of member 41*a* under bottom horizontal flange 6" and over bottom vertical flange 6"" of wall panel 6 and into notch 49 of member 41*a*. After this locking has been achieved then the top of angular member 41*a* is attached to horizontal angle 43*a* by nuts and bolts 14, as illustrated in FIG. 5. When this is accomplished, diagonal support member 41*a* is permanently connected at its bottom to flange 6" of wall panel 6 and cannot be separated therefrom except by reversing the installation operation in order to dismantle the assembly.

Applicant now describes in detail the universally mounted swimming pool stair liner and face plate systems, as illustrated in FIGS. 8, 9, 9*a*, 10, 11, 11*a*, and 11*b*.

Figure 8:
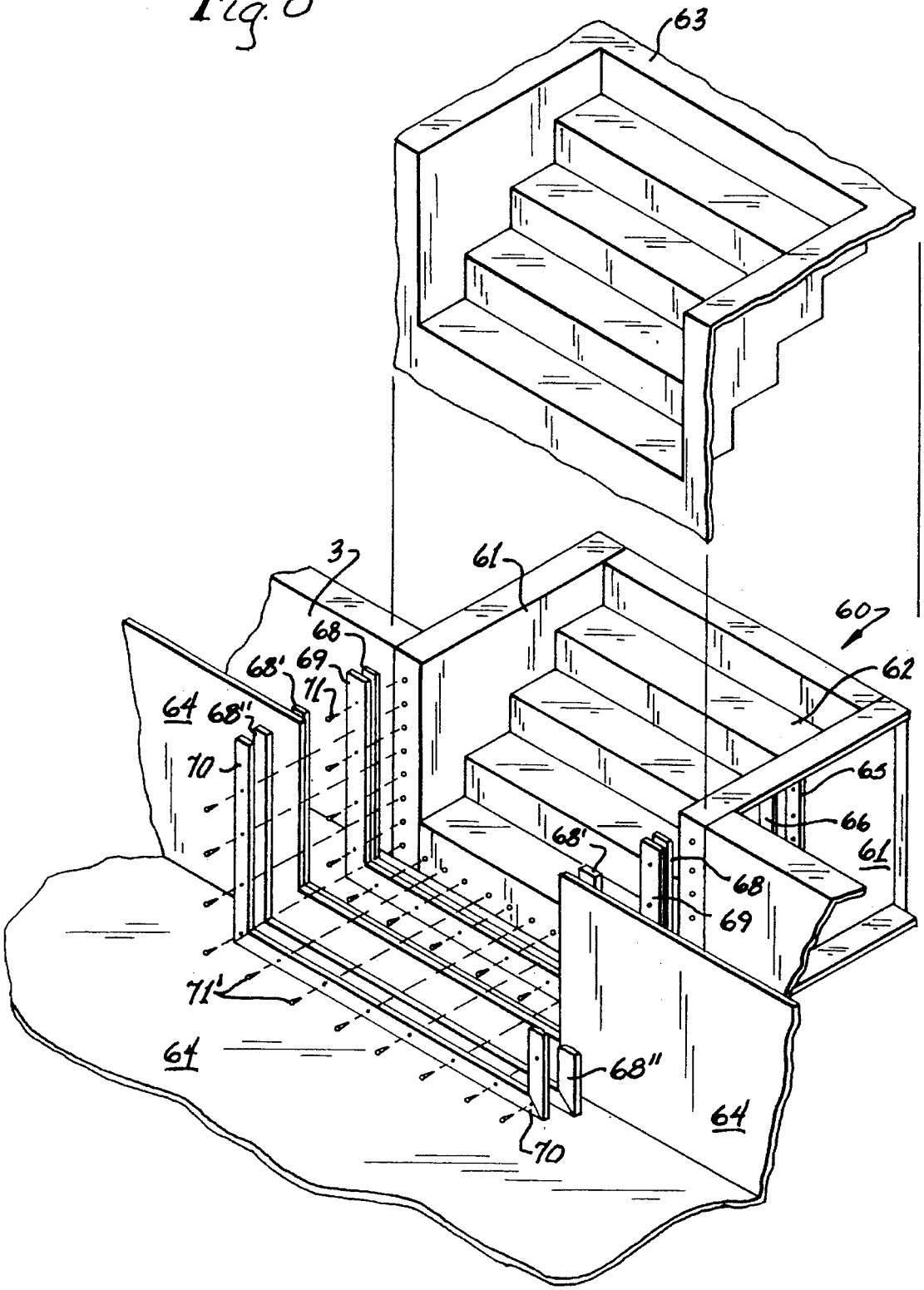
FIG. 8 is an exploded perspective view of the stairs (uncovered with liner) also illustrating installation of the stairs being integrated with the wall of the pool, so that the stairs can be universally mounted anywhere in the pool framework (as also illustrated by reference to FIG. 1).
Figure 11A:
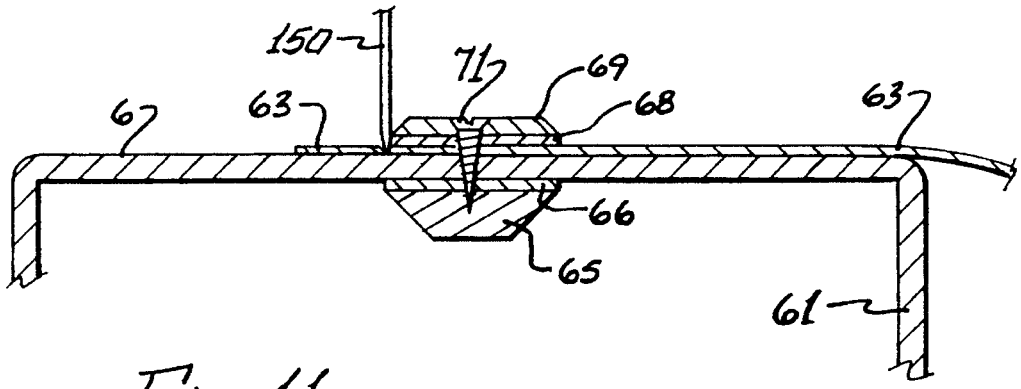
FIG. 11*a* illustrates a first step of the procedure of attaching the stair liner in a water-tight manner according to FIG. 11 and FIG. 8.
Figure 11B:
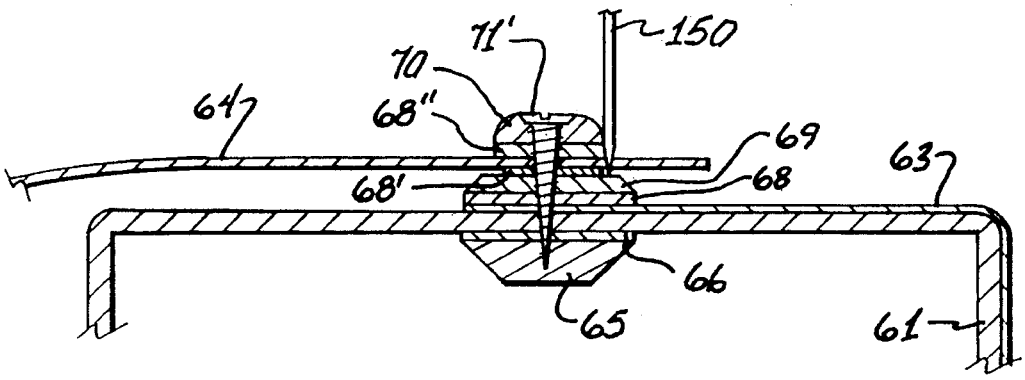
FIG. 11*b* illustrates a second step of the procedure of attaching the pool liner to the stair liner in a water-tight manner according to FIG. 11 and FIG. 8.

In these figures, numeral 60 depicts the stair assembly in general; numeral 61 the side stair wall; numeral 62 the individual stair (both the horizontal and vertical portions); numeral 63 the vinyl liner for the stairs; numeral 64 the liner for the inner surface of the pool; numeral 65 a nut plate for the face plate system; numeral 66 a gasket to cover and water-tightly seal the nut plate; numeral 67 (in FIG. 10) a detent or recess in walls 61 or stairs 62 to better accommodate for insertion and relative smoothness of the surface of the face plate system in the pool; numeral 68 gasket material covering stair liner 63; numeral 69 a middle plate to hold the stair liner in position while the pool liner is being installed and to further assure water tightness and strength of the face plate connection of the stair liner to the stairs; numeral 71 a plurality of self-tapping screws for tightening various members together as depicted in FIGS. 8 and 11; numeral 68' a gasket material which is inserted atop screws 71 and middle face plate 69 in the face plate construction of FIGS. 8 and 11 and below the pool liner 64 in FIGS. 10 and 11. Numeral 68" in FIGS. 8, 11, and 11*b* depicts gasket material atop the pool liner 64, but beneath a top plate 70 in said FIGS. Numeral 71' depicts a second plurality of self-tapping screws at the top of the face plate constructions of the various figures. (The alignments of screws 71 and 71' are staggered so as to avoid interference). Numeral 72 in FIG. 10 depicts an extruded top plate for the connection of FIG. 10; and numeral 73 in FIG. 10 denotes extruded top plate trim which may be slid or glued over the screws 71 or 71' in either the face plate construction of this FIG. (or in the FIG. 11 construction method). In some less preferred construction embodiments, one or both of the gasket layer materials 66 and 68 may be eliminated with only little less assurance of 100% water tightness.

Numeral 150 in FIGS. 11*a* and 11*b* depicts a cutting blade or knife to trim excess stair liner away from around gasket 68 and middle plate 69 in FIG. 11*a*; and to trim pool liner 64 away from around gasket material 68', gasket material 68" and top plate 70 in the face plate construction of FIG. 11*b*. In FIGS. 8, 9, 10, 11, 11*a*, and 11*b* numeral 61 depicts the side walls of the stairs. It should be noted in these figures that middle plate 69 is intentionally made wider than top plate 70 so that it acts as a "cutting board" and protects stair liner 63 when trimming away excess pool liner 64.

Figure 9:
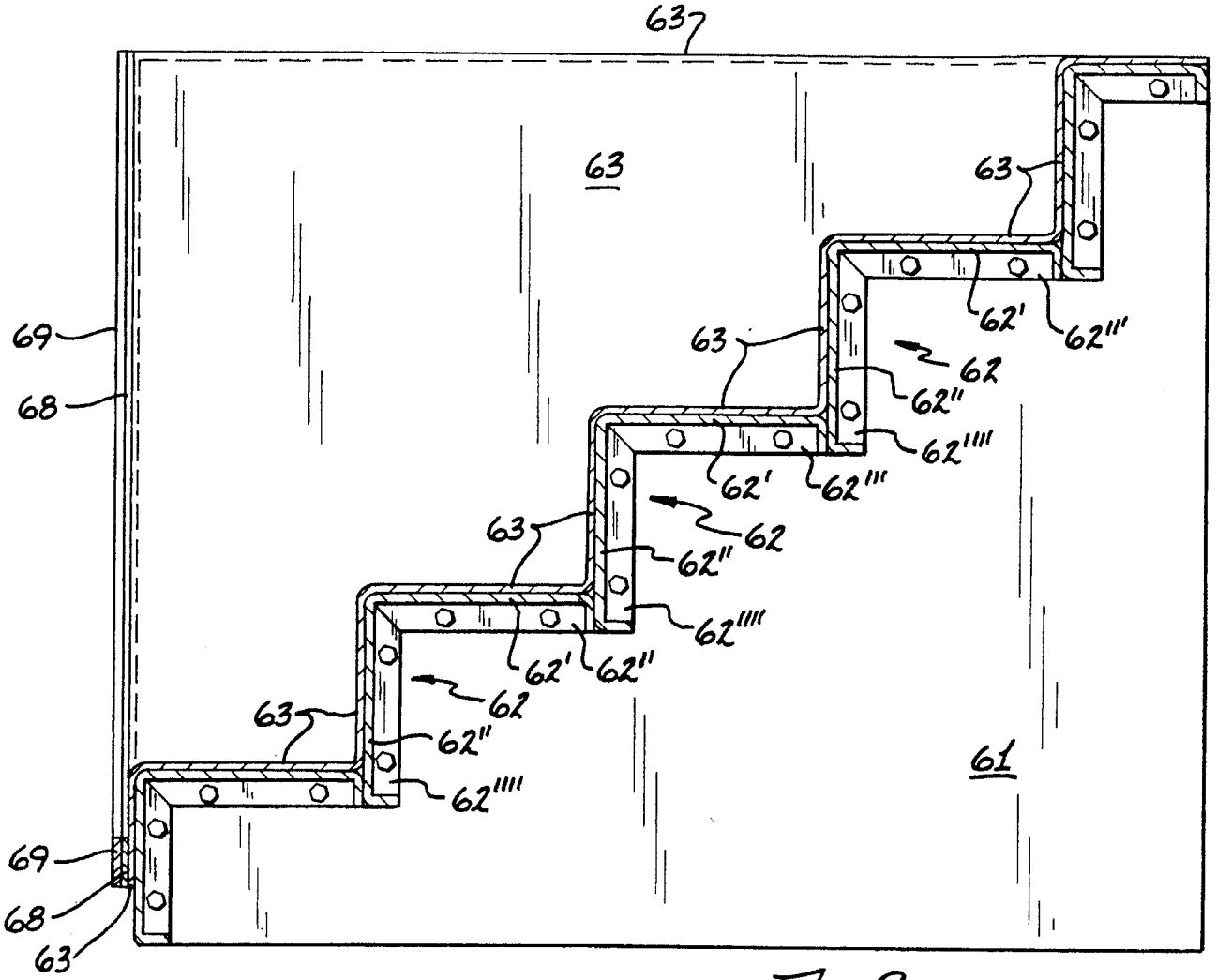
FIG. 9 is a cross section through the stairs of FIG. 8 with the liner attached to the horizontal and vertical portions of the stairs.
Figure 9A:
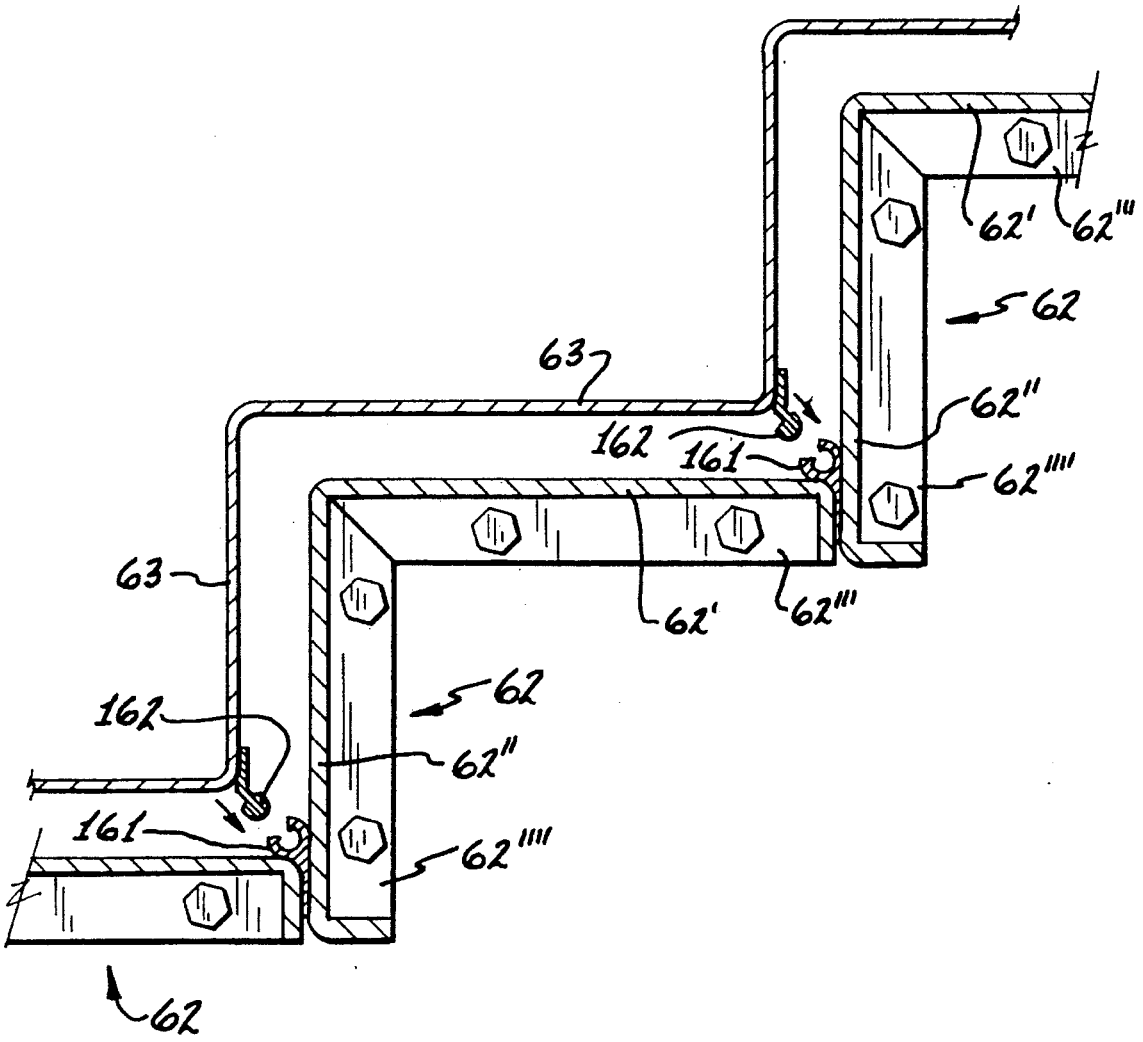
FIG. 9*a* is an enlarged cross-section through a portion of the stairs of FIG. 8, set forth also to show the use of inserts and how the liner is snugly attached to the stairs at intersections of the horizontal and vertical portions thereof.

The sequence of steps of the assembly of the stair liner and the pool liner into the pool should be clear from the foregoing detailed description of the various elements of construction and their assembly, and from a consideration of FIG. 8. FIGS. 9 and 9*a* are additionally helpful to describe the attachment of the stair liner 63 to the individual stairs 62, wherein, as shown, female extrusion receptacles 161 and male extrusion members 162 are employed for snugly attaching the liner to the stairs across the width of the stairs where the horizontal and vertical faces of the stairs met.

In FIGS. 9 and 9*a*, numeral 61 denotes the stair wall, numeral 62 denotes an individual stair, 62' its tread or horizontal surface, 62" its riser or vertical surface, 62'" its horizontal bolting flange and 62"" its vertical bolting flange. Numeral 63 is the stair liner, numeral 68 is gasket material and 69 is the middle plate. Members 161 and 162 were previously referred to. However, the following brief description of the assembly process is added for purposes of additional clarity.

Step 1. Erect the wall panels 6 etc., in the excavation with the stair assembly 60 in the desired location around the pool.

Step 2. Put stair liner 63 (which is one piece preferably) into position in stair assembly 60 holding it in place with middle face plate 69, gaskets 68, nut plate 65 and screws 71. Trim away excess stair liner 63 that extends outside of middle plate 69 with knife 150.

Step 3. Install pool liner 64 in industry accepted manner.

Step 4. Install gasket 68" and top face plate 70 with screws 71'.

Step 5. Trim away excess pool liner 64 (which is now blocking or covering the access to the stair assembly) being extremely careful that the knife blade 150 bears only on the middle plate 69 and does not cut any portion of stair liner 63.

The bracing system of the invention typically employs 14 gauge galvanized steel members, but could be any rigid material, such as plywood, rigid foam or cast aluminum, providing these material are of sufficient thickness and strength. Such material is typically also employed in the construction of the ladder bracket anchor support assembly and in the stairs of the swimming pool.

As previously pointed out, the bracing system works without the use of concrete, either on the braces or around the bottom perimeter of the pool. The idea works by properly using the resistance of the undisturbed earth around the perimeter of the pool and the weight and correct placement of the backfill material reintroduced around the pool as described and illustrated herein by reference to the drawings.

The appealing features of this system are its simplicity and lower costs compared to current methods. This product allows the pool to be successfully installed in one day by less skilled labor than required when using concrete in building pools. Ideally it is now an excellent "do-it-yourself" or user installed product.

The benefits to the user relate back to the above advantages, whereby the homeowner can first of all do this project easily himself, and secondly, save a significant amount of material, thereby saving significant costs in two areas. A third and very substantial benefit to the "do-it-yourselfer" is the peace of mind knowing that a cubic yard of concrete is not going to set before the pool is correct (i.e., straight, plumb or level) causing untold hardship and cost to rectify.

With regard to the ladder bracket anchor support assemblies of this invention, it should be pointed out that ladder anchor supports have been around the in-ground steel and vinyl pool industry for many years. However, up until this invention, provision for their location had to be made to the basic wall panels. Now, with the new clamping device of this invention, the ladder bracket anchor support assembly can be "universally mounted" anywhere around the perimeter of the pool.

The features that make the idea unique and the needs that it fulfills are: the ladder for the entry and exit to the swimming pool can now be mounted quickly and easily anywhere on the perimeter of the pool, without any special drilling, riveting, welding, or use of concrete, etc.

Benefits that the user receives are: the ability to install the ladder bracket anchor support assembly anywhere around the perimeter of the pool quickly and easily. This invention should also be particularly attractive to users installing their own pools; such as those who use the new "do-it-yourself" "pool in a day" bracing system concept, which can also be installed without perimeter concrete and without drilling holes through 14 gauge galvanized steel.

Problems that the idea solve are: for the manufacturer of the pool walls, it eliminates the need to drill or punch multiple, matching holes in each wall panel to give the homeowner or installer the choice Of ladder locations; and for the pool contractor or do-it-yourselfer and user, it eliminates the need for concrete to locate the ladder bracket anchor support assembly at the deck surface, or if the ladder bracket anchor support assemblies are used, it eliminates the need for concrete on the bottom of the pool walls; and finally for pools which do not have concrete decks around them, this idea provides a secure method for anchoring the ladder anywhere around the perimeter of the pool.

Lastly, with regard to the universally mounted vinyl swimming pool stair liner and face plate system, it is recognized that steel (or wood, etc.) stair structures in liner pools have been in existence for many years, but the location of the stairs has had to be determined at the time of purchase of the pool, so that the factory manufacturing the pool kit knew at what point around the perimeter of the liner to attach the vinyl stairs to that they would match up with the steel (or wood or plastic) portion of the stairs when the pool was finally installed in the ground. The new invention of this application allows a pool liner to be made and shipped to the site with no concern for whether or not there will be any stairs into the pool, or if there are stairs, in what location around the pool they will be installed.

The features that make the invention unique and appealing are: the swimming pool can now have matching and color coordinated vinyl stairs which can be mounted in any location and because the substructure is steel (or rigid material) it also adds to the overall strength of the perimeter structure of the pool. The invention also allows homeowners or installer of pools with vinyl covered stairs to locate the stair liner and stairs at any position around the pool at which the steel portion of the stairs can be located.

Benefits of the Pool Stair Liner And Face Plate System

As a manufacturer of the products, it should be kept in mind that he could have two users of the pool; one is the retailer or contractor and the second is the homeowner or do-it-yourself installer.

The benefits to the retailer/contractor are: a) the pool kit is much easier to order (purchase) if he does not have to specify a stair location at the time of order; b) it is safer to purchase because there is no chance of a stair location error during the manufacturing of the liner; and c) pools and liners are easier to inventory because they can be sold with or without the stair option at the request of the customer.

The benefits to the homeowner or do-it-yourself installer are: a) he can have a matching color and print on both his liner and stairs and still determine the location of the stairs at the last stages of the pool wall installation. This allows last minute landscaping and decorating decisions or ideas.

The benefits to both the retailer/installer or homeowner/installer are that the pool liner and stair liner arrive in separate packages, which means that each package is lighter in weight and easier to handle, and most importantly, the stair liner can be installed first, adjusted for fit and smoothness, and then forgotten about while the much larger pool liner is installed. This makes for a much easier installation.

Additional advantages or problems that the invention solves are: a) stocking and warehousing the pool liners and stair liners at both the manufacturing and the retailing level is simpler, more convenient, cheaper and more versatile, and b) it allows the choice of vinyl stair location to be made at the job site as the pool is being installed.

The foregoing description and embodiments are intended to illustrate the invention without limiting it thereby. It will be understood that various modifications can be made in the invention without departing from the spirit or scope thereof.

I claim:

1. Earth bracing means for excavated in-ground swimming pools, said bracing means comprising the following elements:

a structural wall of the swimming pool, said wall being about 42 inches high;

a substantially horizontal support member connected to the wall structural near its base, said horizontal member being about 28¾ inches long and having means for enabling a controllable distance of its end away from the wall;

a substantially vertical support member connected to the horizontal support member near or at its end that is distant from the structural wall, said vertical member being about 26⅜ inches in height;

a first diagonal support member about 42 inches long, one end of which is connected to the structural wall A about 4¾ inches below its top and the other end of which is connected to the horizontal support member about 5 inches from its end that is distant from the wall, said diagonal support member being at an angle of about 45 degrees from the horizontal support member;

a second diagonal support member which is also connected to the structural wall at about the same location that first diagonal support member is connected to the wall, said second diagonal support member being connected to the top of the substantially vertical support member about 37¼ inches from where it is connected to the structural wall and said second diagonal support member also having means for enabling a controllable distance of its end away from the structural wall a first substantially rectangular load bearing pad assembly, operatively coupled to the substantially horizontal support member for abutting against a flat substantially vertical face of earth undisturbed by the excavation of the ground area from around the pool so as to assist in maintaining the structural wall in a vertical position; and a second substantially rectangular load bearing pad assembly operatively coupled to the second diagonal support member for abutting against a flat angular face of earth undisturbed by the excavation of the ground area from around the pool so as to cooperatively assist the first substantially rectangular load bearing pad assembly in maintaining the structural wall in a vertical position.

2. Earth bracing means according to claim 1 including two vertical stakes coupled to panels of the structural wall at its base, said stakes being about 10 to 16 inches long, one on each end of each panel of the structural wall, and driven into the earth a distance of about 90% of their length so as to contribute additional structural stability to the vertical position of the structural wall of the swimming pool.

3. Earth bracing means for excavated in-ground swimming pools, said bracing means comprising the following elements:

a structural wall of the swimming pool, said wall being about 42 inches in height;

a substantially horizontal support member connected to the wall structural near its base, said horizontal member being about 28¾ inches long;

a substantially vertical support member connected to the horizontal support member near or at its end that is distant from the structural wall, said vertical member being about 26⅜ inches in height;

a first diagonal support member about 42 inches long, one end of which is connected to the structural wall about 4¾ inches below its top and the other end of which is connected to the horizontal support member about 5 inches from its end that is distant from the wall, said diagonal support member being at an angle of about 45 degrees from the horizontal support member;

a second diagonal support member which is also connected to the structural wall at about the same location that the first diagonal support member is connected to the wall, said second diagonal support member being connected to the top of the substantially vertical support member about 37¼ inches from where it is connected to the structural wall;

extension horizontal support means atop the horizontal support member, and connected to same in a manner for enabling a controllable distance of its end away from the structural wall;

extension angular support means atop the second diagonal support member and connected to same in a manner for enabling a controllable distance of its end away from the structural wall;

a first substantially rectangular load bearing pad assembly connected to the end of the extension horizontal support means for abutting against a flat substantially vertical face of earth undisturbed by the excavation of the ground area from around the pool so as to assist in maintaining the structural wall in a vertical position; and a second substantially rectangular load bearing pad assembly connected to the end of the extension angular support means for abutting against a flat angular face of earth undisturbed by the excavation of the ground area from around the pool so as to cooperatively assist the first substantially rectangular load bearing pad assembly in maintaining the structural wall in a vertical position.

4. Earth bracing means according to claim 3 including 2 vertical stakes coupled to panels of the structural wall at its base said stakes being about 10 to 16 inches long, one on each end of each panel of the structural wall, and driven into the earth a distance of about 90% of their length so as to contribute additional structural stability to the vertical position of the structural wall of the swimming pool.

5. Earth bracing means according to claim 1 wherein the structural wall of the swimming pool is made from 14 gauge galvanized steel and the various support members are angle irons of 14 gauge thickness.

6. Earth bracing means according to claim 3 wherein the structural wall of the swimming pool is made from 14 gauge galvanized steel and the various support members are angle irons of 14 gauge thickness.

7. Earth bracing means according to claim 1 wherein the various dimensions indicated can be varied by about plus or minus ten-percent so long as they are so coordinated as to contribute to and result in constructing and maintaining the structural wall or the swimming pool in a substantially vertical position.

8. Earth bracing means according to claim 3 wherein the various dimensions indicated can be varied by about plus or minus ten-percent so long as they are so coordinated as to contribute to and result in constructing and maintaining the structural wall of the swimming pool in a substantially vertical position.

* * * * *